US011519692B2

(12) United States Patent
Thomele et al.

(10) Patent No.: US 11,519,692 B2
(45) Date of Patent: Dec. 6, 2022

(54) SIGHT ASSEMBLY AND SYSTEM WITH FIREARM STATUS INDICATOR

(71) Applicant: Sig Sauer, Inc., Newington, NH (US)

(72) Inventors: Adrian Thomele, Stratham, NH (US); Scott D. Shinkle, Greenland, NH (US); Evan Miller, Exeter, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/235,617

(22) Filed: Apr. 20, 2021

(65) Prior Publication Data

US 2021/0325146 A1 Oct. 21, 2021

Related U.S. Application Data

(60) Provisional application No. 63/012,535, filed on Apr. 20, 2020.

(51) Int. Cl.
*F41G 1/30* (2006.01)
*F41A 9/62* (2006.01)
*F41A 9/53* (2006.01)

(52) U.S. Cl.
CPC ..... *F41G 1/30* (2013.01); *F41A 9/53* (2013.01); *F41A 9/62* (2013.01)

(58) Field of Classification Search
CPC ..... F41A 9/53; F41A 9/62; F41G 1/30; F41G 1/345
USPC ..... 42/1.02
See application file for complete search history.

(56) References Cited

U.S. PATENT DOCUMENTS 6,286,242 B1 * 9/2001 Klebes ..... F41A 19/58 42/84
2008/0039962 A1 * 2/2008 McRae ..... G01S 17/88 356/3
2015/0219425 A1 * 8/2015 Beckman ..... F41H 11/00 89/1.11
2015/0377572 A1 * 12/2015 Darragjati ..... F41A 9/65 42/50
2020/0025518 A1 * 1/2020 Nackel ..... F41G 1/30
2020/0232762 A1 * 7/2020 Hamilton ..... F41A 9/65
2021/0372737 A1 * 12/2021 Masarik ..... G02B 23/04

* cited by examiner

*Primary Examiner* — John Cooper
(74) *Attorney, Agent, or Firm* — Finch & Maloney, PLLC

(57) ABSTRACT

A sight assembly for a firearm includes an optical sight configured for mounting to a firearm. The optical sight includes a sight body retaining a lens and has a point-of-aim indicator visible on the lens. A light source on the sight body is configured to communicate a firearm status to a user, such as whether a round is chambered in a chamber of the firearm. In one example, the sight assembly can be mounted to a handgun or atop a rifle. In some embodiments, the optical sight is configured as a reflex sight.

22 Claims, 11 Drawing Sheets

SIGHT ASSEMBLY AND SYSTEM WITH FIREARM STATUS INDICATOR

RELATED APPLICATIONS

This application claims the benefit under 35 U.S.C. § 119(e) of U.S. Provisional Patent Application No. 63/012,535 titled SIGHT ASSEMBLY AND SYSTEM WITH FIREARM STATUS INDICATOR, filed on Apr. 20, 2020, the contents of which are incorporated herein by reference in its entirety.

FIELD OF THIS DISCLOSURE

This disclosure relates to sighting assemblies for firearms and more specifically to a sight assembly and sight system with a firearm status indicator.

BACKGROUND

Firearms operators often use some type of sight to assist in aligning a shot to impact a target at the desired location. For example, rifles and pistols often include a front sight and a rear sight mounted on the top of the barrel, where the operator aligns the front sight (e.g., a post) with the rear sight (e.g., a notch or V) to establish a sight picture with the intended target. Such sights may be referred to as "iron sights" since they traditionally have been made of metal. A variant of these sights uses fiber optics or a radioactive material (e.g., tritium) that illuminates part of the sight. In one example, the front sight on handguns includes a tritium vial that illuminates in low light conditions. In another example, front and rear sights include a fiber optic tube that is illuminated by ambient light and provides a more distinct sight picture for the user. Other sights include optical or telescopic sights that provide a reticle (e.g., crosshairs) that is visible on the lens and which the operator aligns with the target. In yet another example, a reflex sight (or "red dot" sight) has non-magnifying or low-magnification lens onto which the operator can see a reflection of an illuminated aiming point or "red dot" superimposed over the field of view. The red dot can be light from a laser or light emitting diode (LED) located in the body of the sight and directed to reflect off of the lens to be visible to the user.

Figure 1:
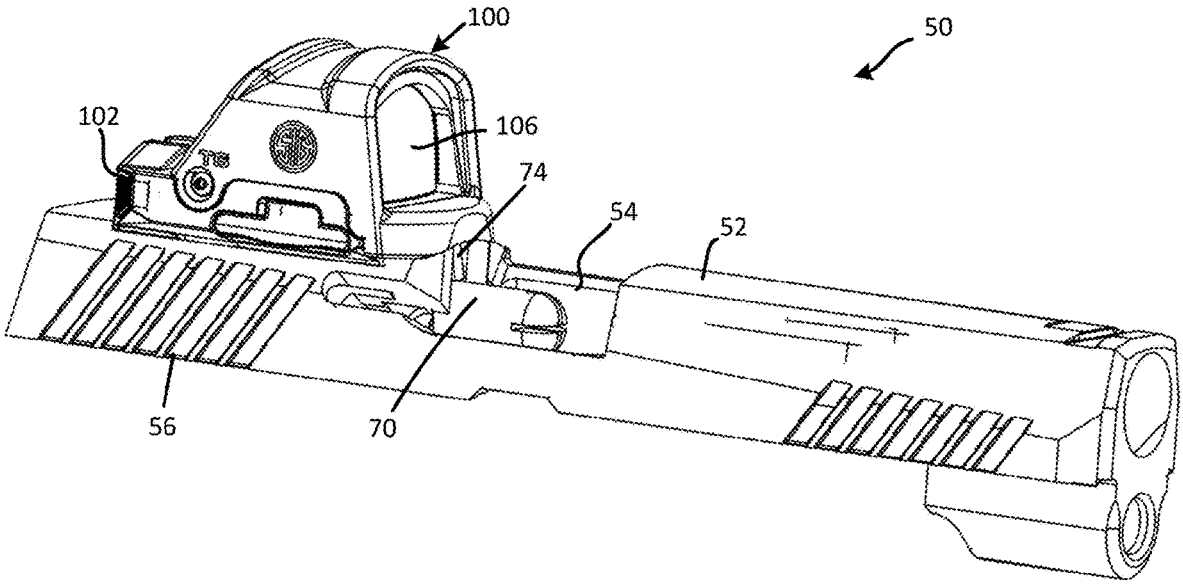
FIG. 1 is a perspective view showing the top, front, and right sides of a slide and sight assembly of a semiautomatic handgun, in accordance with one embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a sight assembly and sight system with a firearm status indicator, in accordance with some embodiments. In one example, a sight assembly for a handgun or rifle is configured as a reflex or "red dot" sight. In addition to displaying the dot or other point-of-aim indicator, the sight is also configured to display one or more firearm status indicator, such as (i) the chamber status (loaded or unloaded), (ii) the relative quantity or a number of rounds in the magazine, and (iii) the position of the safety or selector switch (e.g., safe, auto, semi auto, burst).

In one such embodiment, the status indicator is activated mechanically and illuminates a light emitting diode (LED) or laser. For example, when a round is chambered in a handgun, part of the cartridge casing engages a lever and displaces the lever upward to contact a switch button or contact pad on the bottom of a sight assembly mounted on the slide. By closing the circuit, a light source is powered to provides a number, a symbol, or other indicium (e.g., green light) on the lens or on the body of the sight assembly that is visible to the user can when aiming the handgun. Similarly, when no round is chambered, the user may not see a status indicator or may see a different indicator, such as a yellow light indicating an empty chamber. Mechanical actuation of a switch can be accomplished using the loaded chamber indicator, slide release lever, ejector, position of the slide relative to the frame, or other moving part of the firearm.

In another embodiment, the status indicator, whether a loaded chamber indicator, round count, or other status, is part of a firearm system that includes the sight assembly, the firearm, and a magazine configured to be part of a sensor assembly or circuit to communicate a condition to the sight assembly when used with the firearm. In one such example, Hall-effect sensors in the magazine well detect the position of the magazine follower based on proximity to a magnet in the follower. In doing so, the signal from one of the Hall-effect sensors is converted to a round count or relative ammunition quantity that is communicated to the user by way of a light on the sight assembly. In another embodiment, the magazine follower has a RFID tag that communicates its position in the magazine tube to a signal receiver in the reflex sight. Based on the position of the follower in the magazine tube, the sight assembly provides one or more symbols to indicate the number of available rounds or relative quantity of ammunition in the magazine. In yet another embodiment, tritium vials at specific locations on the magazine provide light that is detected by optical sensors in the magazine well. The position of the activated sensor indicates the quantity of ammunition in the magazine. In another embodiment, a rheostat or the like on the magazine tube is part of a circuit that can be used to determine the number of rounds in the magazine based on the follower position and to display the round count to the user on the lens.

Whether a sensed condition or firearm components included in an electrical circuit, a signal (e.g., voltage) at the sight assembly is interpreted by the sight assembly to power a light source and provide a status indicator (e.g., ammunition count) visible to the user. The signal may indicate the position of a safety selector, a quantity of ammunition in the magazine, or other condition. For example, the sight assembly illuminates a LED to indicate the status of the chamber indicator, displays a numerical value for the number of rounds in the magazine, displays a word or symbol to indicate the position of the safety selector, or other firearm status.

A method of use is also disclosed. For example, an indicator system is used to track or record the number of shots fired, the history of use, performance data, or other information. In one embodiment, a signal from the firearm's chamber indicator, magazine, or other component can be used to record the total number of rounds fired, the date and time of each fired round, the rate of fired rounds, performance data (e.g., time between shots in a string of shots) or other data. Recoil forces can be used to identify a shot fired. Recorded data can be used, for example, for maintenance purposes, training purposes, firearm depreciation, or to identify timing or other information about shots fired by a law enforcement officer in a shooting incident.

Sight assemblies, systems, and methods of the present disclosure can be used with handguns, shotguns, combat and tactical rifles, machine guns, carbines, and the like. Sight assemblies include open and closed reflex sights, rifle scopes, battle sights, thermal reflex sights, variable and fixed magnification optical scopes, to some examples. Numerous variations and embodiments will be apparent in light of the present disclosure.

General Overview

Firearms design involves many non-trivial challenges. Maintaining a sight picture and sight alignment are important aspects of accurate shooting. Moving while shooting, firing a string of several shots, recoil forces, and rapid shooting can affect one's ability to maintain proper sight alignment on a target. To facilitate rapid target acquisition with handguns and rifles, optical sights with illuminated reticles have been developed. One example sight is a variable magnification optical sight that can be mounted on a rail along the top of a rifle. Some such sights have an illuminated reticle, such as cross hairs, a circle, a triangle, or a dot. A variation on sights with illuminated reticle is a low-magnification or 1×-magnification reflex sight. Reflex sights are one type of optical sight that has been adapted for use on rifles and handguns alike.

During a tactical shooting exercise or firefight, for example, the shooter's movement, stress, and concentration on engaging a target can make it difficult to know how many shots have been fired or how many rounds remain in the magazine. As a result, the shooter may initiate an engagement or move to a new position with an empty or near-empty magazine. On the other hand, the shooter may unnecessarily drop the current magazine and install a fully loaded magazine into the firearm to ensure having a full magazine. In yet other situations, the shooter may need to break the sight picture to check the status of the magazine, chamber, or other firearm condition. In some situations, performing this check may place the shooter in danger by giving the target an opportunity to shoot or attack. Thus, it would be desirable to be able to know the firearm's status while maintaining the sight picture and sight alignment on the target. The present disclosure addresses this need by providing a sight assembly and sight system that provides a firearm status indicator.

In accordance with one embodiment, a reflex sight includes a switch that is actuated to turn on a chambered round indicator when a round is chambered. In one such embodiment, the cartridge of a chambered round toggles a lever to depress a switch on the bottom of a reflex sight housing. In turn, a light on the sight housing or a symbol on the lens is illuminated to indicate the presence of a chambered round. In some embodiments, a small LED on the rear face of the housing illuminates green to indicate a chambered round. The indicator may alternately appear on the lens or at some other location on the sight. Optionally, the status indicator may change to red or yellow when the chamber is empty. In some embodiments, the status indicator optionally represents the number of rounds remaining, the status of the firearm safety or selector switch, or other firearm condition.

In another example embodiment, a sight system includes an optical sight in communication with a magazine. For example, the sight body includes a radio frequency (RF) transceiver that receives a signal from an RF tag on the magazine follower. Based on the position of the follower in the magazine, the sight can display a round count or symbol representing the approximate fill level of the magazine, similar to a battery charge indicator. In other embodiments, the firearm's safety switch or selector switch communicates with the sight (wired or wirelessly), where the sight is configured to display the switch setting (e.g., safe, fire, auto, burst, semi-auto, etc.) based on the position of the selector switch. In some embodiments, moving a control from one position to another closes an open circuit or actuates a switch to complete a circuit.

In yet another embodiment, the sight system is used in a method of tracking firearm performance data. For example, the sight is programmed to record shots fired, the times of shots fired, barrel angle or other firearm position at the time of firing, or other suitable data. Such data can be used, for example, to identify the number of shots fired (e.g., for firearm maintenance purposes), the amount of muzzle rise after a shot, or other data to improve shooting performance, and to track shots fired in shooting incidents.

As will be appreciated in light of this disclosure, and in accordance with some embodiments, a sight assembly and sight system can be used with a wide variety of host firearms, including handguns and rifles configured for duty use, concealed carry, competitive shooting, law enforcement, military, self defense, and recreation. In some example embodiments, the sight assembly is a reflex sight configured for mounting atop the slide of a semiautomatic handgun, such as the P365, P320, and P226 handguns manufactured by Sig Sauer, Inc. Other example embodiments include optical sights configured for mounting on a rifle. As will be further appreciated, the particular configuration of the sight assembly and systems described herein may vary, for example, depending on whether the intended use is military, law enforcement, or civilian in nature. Numerous configurations will be apparent in light of the present disclosure.

EXAMPLE EMBODIMENTS

Figure 2:
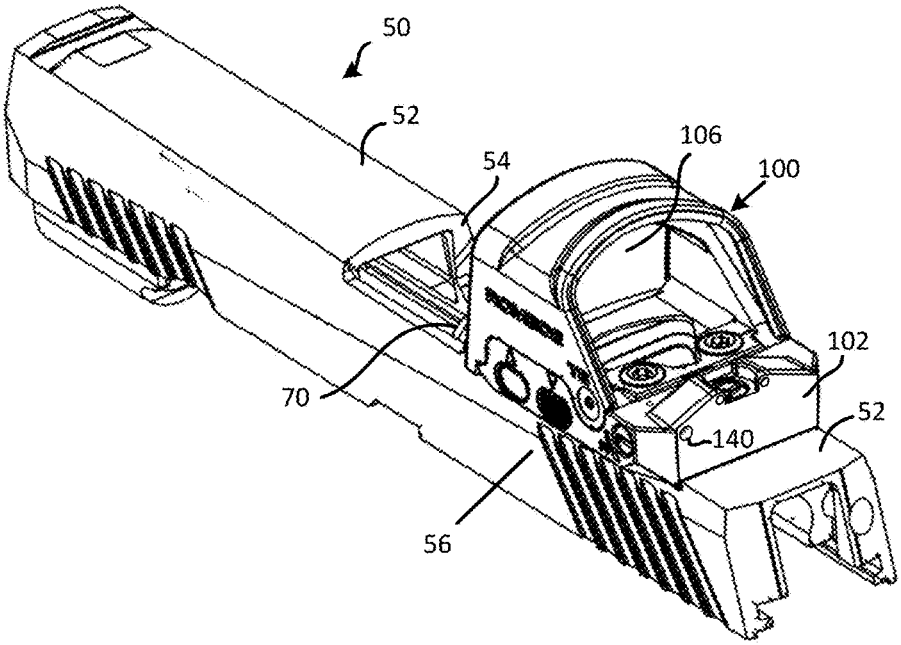
FIG. 2 is a perspective view showing the top, rear, and left sides of the slide and sight assembly, in accordance with an embodiment of the present disclosure.

FIG. 1 illustrates front and side perspective view and FIG. 2 illustrates a top and rear perspective view of a semiautomatic handgun slide 50 with a mounted sight assembly 100, in accordance with an embodiment of the present disclosure. In this example, the slide 50 has a top surface 52 and defines an ejection port 54. The sight assembly 100 is configured as a reflex sight and is mounted on the top surface 52 of the proximal end portion 56 of the slide 50 behind the ejection port 54. A chambered round 70 is shown in the ejection port 54 and is positioned where it would be when chambered in the proximal end portion of the barrel when the slide 50 in the battery position, as will be appreciated. For clarity of illustration, the barrel and remainder of the handgun are not shown.

The chambered round 70 upwardly displaces a lever 74 into a position where it contacts a switch 78 (not visible; shown in FIG. 8) on the bottom of the sight assembly 100. In this position, also referred to as the "on" position in some embodiments, the lever 74 actuates the switch 78 to turn on a status indicator 140. In this example, the status indicator 140 is an LED or the like on the rear end 102 of the sight assembly 100. In other embodiments, the status indicator 140 can be illuminated on or reflected from the rear face of the lens 106 or other location visible to the user. For example, the lens 106 (or other suitable surface on the sight assembly 100) is used to reflect a laser so that the status indicator 140 is visible to the user. In the absence of a chambered round 70, the lever 74 is biased downward by a spring to an "off" position. In a situation where the round fails to go to battery, the lever 74 may not move upward sufficiently to actuate the switch, and therefore the indicator for a chambered round is not illuminated. In some embodiments, the switch may have more than one "on" position, such as one for a chambered round, another on position for an empty chamber, and another on position to indicate a round in/near the chamber but that is not fully chambered (e.g., an out-of-battery malfunction).

Figure 3:
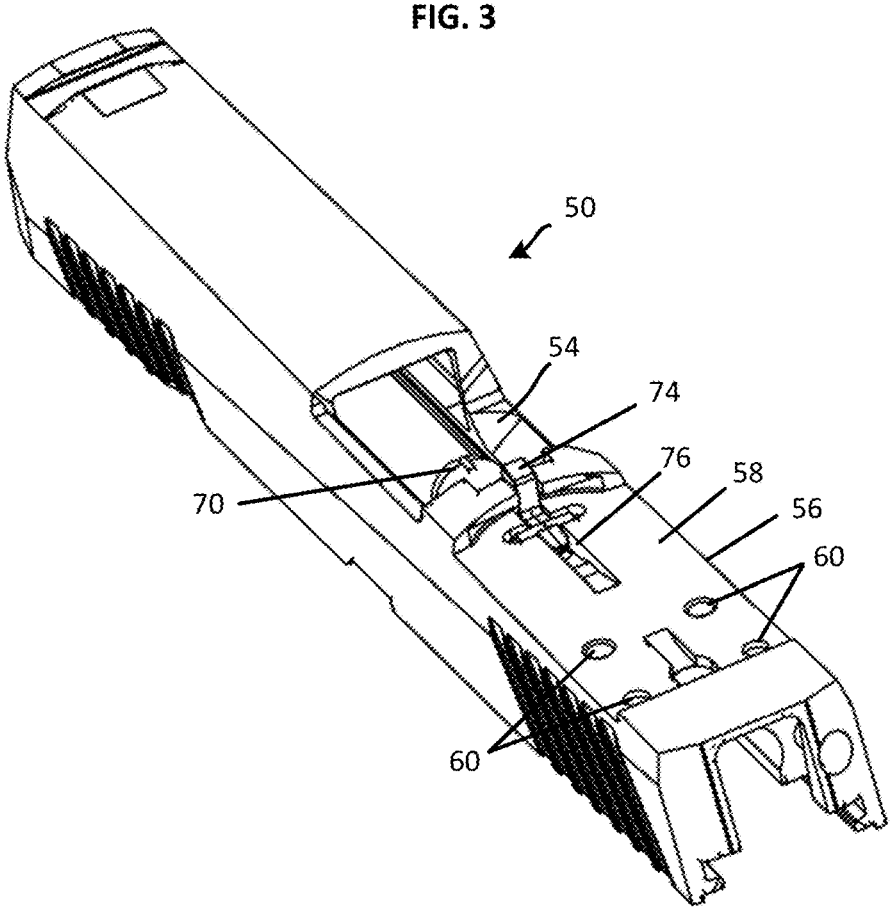
FIG. 3 is a perspective view showing the top, rear, and left sides of a slide with lever, in accordance with an embodiment of the present disclosure
Figure 4:
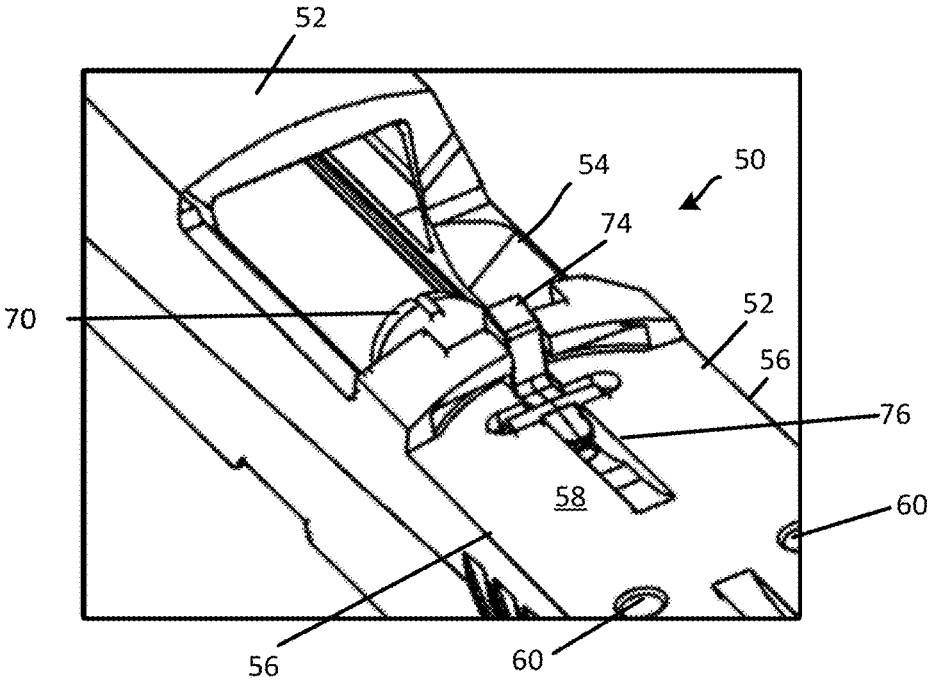
FIG. 4 is a close-up view showing the lever and ejection port of the slide of FIG. 3.

Referring now to FIG. 3, a top and rear perspective view shows the slide 50 without the sight assembly 100 to more clearly show the lever 74, in accordance with one embodiment. FIG. 4 is a close-up view of part of the slide 50 shown in FIG. 3, showing the lever 74, chambered round 70, and ejection port 54. In this example, the proximal end portion 56 of the slide 50 defines a recessed area 58 for mounting the sight assembly 100 (shown in FIGS. 1-2). Note, however, that the recessed area 58 is not required, and for purposes of this disclosure, the top surface 52 includes the top surface of the slide 50 whether the slide 50 includes or omits recessed area 58. The sight assembly 100 can be secured the slide 50 in the recessed area 58 using one or more methods, including mechanical fasteners, a snap fit, an adhesive, and combinations of these and other methods. In accordance with one embodiment, the slide 50 defines at least one fastener opening 60 within the recessed area 58 (or top surface 52 of the proximal end portion 56), such as two, three, four, six, or other number of fastener openings 60. At least some of the fastener openings 60 are positioned to align with a corresponding fastener opening of the sight assembly 100 to be installed in the recessed are 58. For example, one or more of the fastener openings 60 are threaded bores configured to receive complimentary machine screws that are arranged at various locations to accommodate the hole pattern of a particular sight assembly 100 or that is common to a plurality of sight assemblies 100. In embodiments where fasteners are used to secure the sight assembly 100, the fasteners can extend vertically through the sight assembly 160 and into the fastener openings 60.

In this example, all or part of the lever 74 (e.g., a loaded chamber indicator) occupies a slot 76 defined in the top surface 52 such that the lever 74 is beneath the sight assembly 100 and positioned to engage a switch 78 on the bottom of the sight assembly 100, in accordance with some embodiments. In this example, the lever 74 is in the "on" position due to the presence of the chambered round 70. As such, part of the lever 74 extends upward above the top surface 72 of the slide a distance sufficient to actuate a switch on the sight assembly 100.

In this example, the shell casing of the chambered round 70 (e.g., the cartridge rim) contacts the lever 74 and pivots the lever 74 upward to actuate the switch on the sight assembly 100. In some embodiments, the lever 74 is part of the switch or otherwise integral to the sight assembly 100 such that a separate component is not necessary to actuate the switch 78. In one example, the switch 78 has a button or actuator that is positioned to directly contact the chambered round 70.

In another embodiment, the switch 78 utilizes a change in conductivity or a circuit being completed by contact with the metal casing, rather than an actuator or other moving part. In one such embodiment, the shell casing of the chambered round 70 makes contact with an electrical contact pad, which causes a change in conductivity that is sensed by a controller or chip in the sight assembly 100, and in turn illuminates the status indicator 140. Numerous variations and embodiments will be apparent in light of the present disclosure.

Figure 5A:
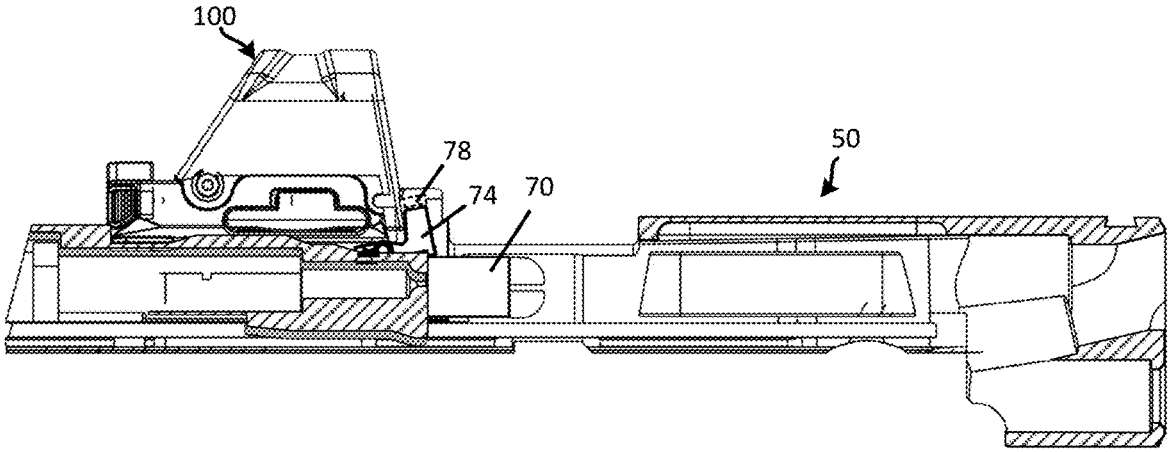
FIG. 5A is a side and partial cross-sectional view of a slide and sight assembly showing a chambered round and the lever in an up position, in accordance with an embodiment of the present disclosure.
Figure 5B:
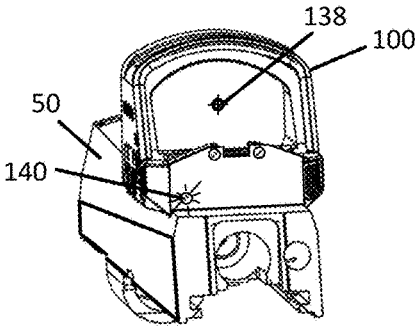
FIG. 5B is a rear perspective view of the sight assembly of FIG. 5A showing a firearm status indicator on the rear face of the sight housing in an "on" condition, in accordance with an embodiment of the present disclosure.

Referring now to FIG. 5A a side and partial cross-sectional view shows portions of the slide 50, sight assembly 100, and lever 74 in an "on" position or chambered-round position. Here, a chambered round 70 pivots the lever 74 upward to make contact with and actuate the switch 78 on the underside of the sight assembly 100. FIG. 5B illustrates a rear perspective view of the slide 50 and sight assembly 100 and shows the point-of-aim indicator 138 and status indicator 140. When the sight assembly 100 is powered on, a point-of-aim indicator 138 (e.g., red dot) is visible on the lens 106 of the sight assembly 100 and the status indicator 140 (e.g., green light) is visible on the rear end 102 of the sight assembly 100. Here, the status indicator 140 is illuminated based on the presence of the chambered round 70, such as shown in FIG. 5A.

Figure 6B:
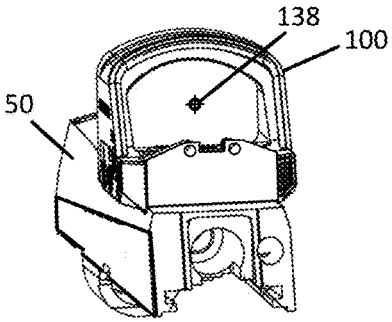
FIG. 6B is a rear perspective view of the sight assembly of FIG. 6A showing the status indicator in an "off" condition, in accordance with an embodiment of the present disclosure.
Figure 6A:
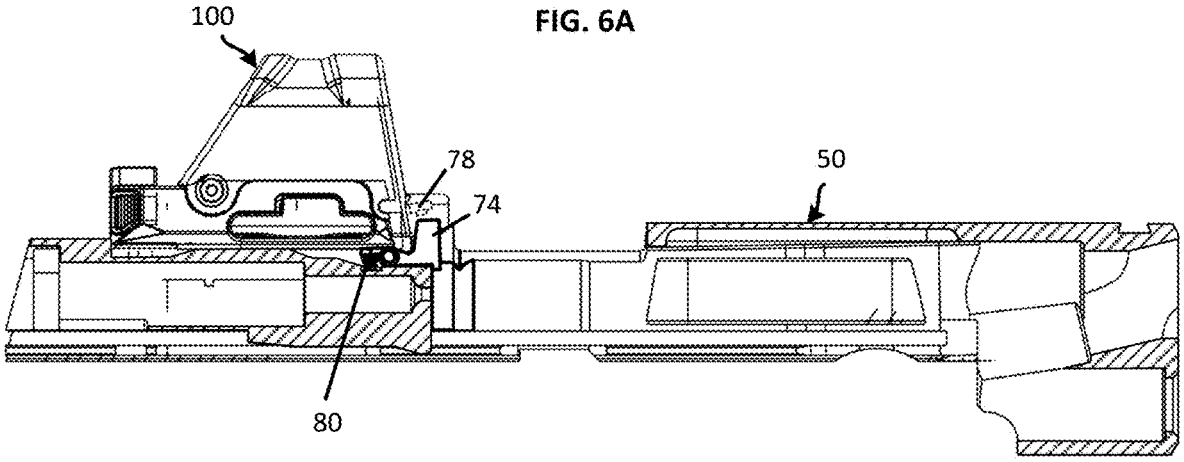
FIG. 6A is a side and partial cross-sectional view of the slide and sight assembly of FIG. 5A showing the absence of a chambered round, in accordance with an embodiment of the present disclosure.

Referring now to FIG. 6A a side and partial cross-sectional view shows portions of the slide 50, sight assembly 100, and lever 74 in an "off" position or empty-chamber position. Here, the chamber is empty so the lever 74 is pivoted down due to a spring 80 acting on the proximal end of the lever 74. In the down position, the lever 74 is disengaged from (or otherwise fails to actuate) the switch 78 on the underside of the sight assembly 100.

FIG. 6B illustrates a rear perspective view of the slide 50 and sight assembly 100 with the sight assembly 100 powered on. The point-of-aim indicator 138 is visible on the lens 106 of the sight assembly 100, but the status indicator 140 is not illuminated due to the lack of a chambered round 70, such as shown in FIG. 6A. Without a chambered round 70, the lever 74 does not actuate the switch 78 to illuminate the status indicator 140. In some embodiments, an empty chamber may cause illumination of an alternate status indicator 140 or different illumination of the same status indicator 140. For example, instead of a green light indicating the presence of a chambered round 70 when the switch 78 is actuated, the status indicator 140 can be a yellow light that indicates an empty chamber or out-of-battery condition when the switch 78 is not actuated. In another example, when no round is chambered, the point-of-aim indicator 138 changes to a red X or some other symbol (e.g., instead of a red dot) to indicate the empty chamber. Accordingly, the status indicator 140 may be combined to some extent with the point-of-aim indicator 138 in some embodiments.

Figure 7:
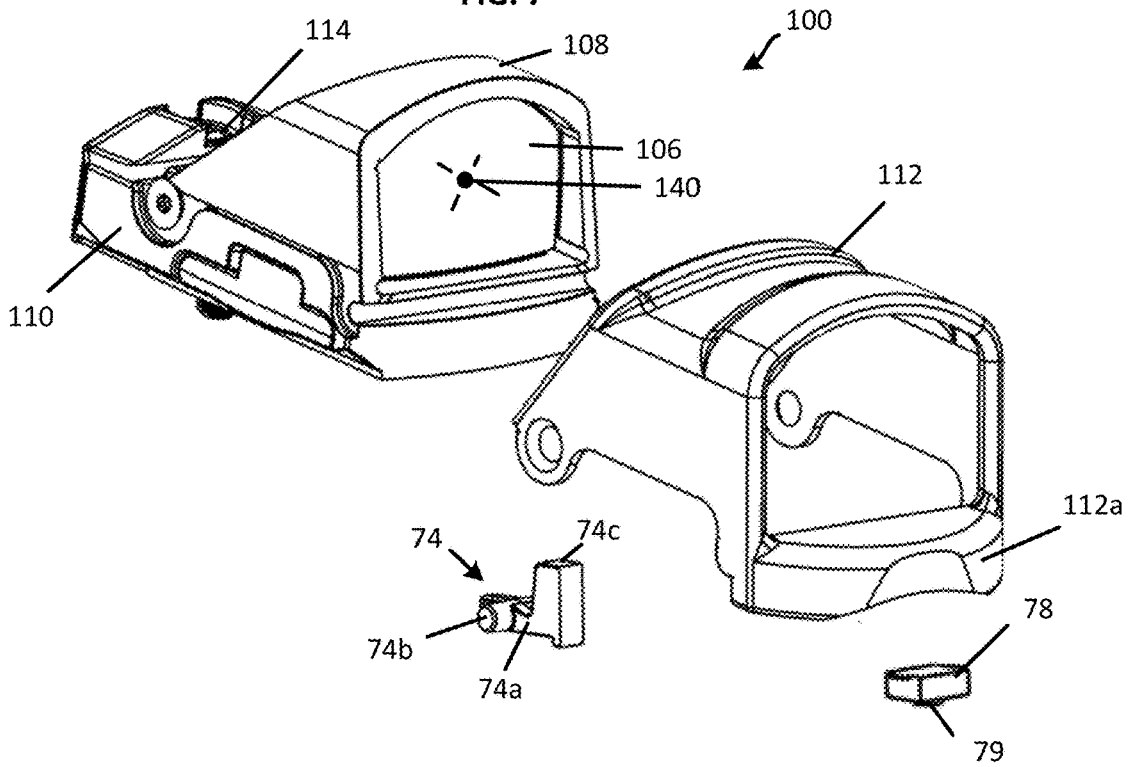
FIG. 7 is an exploded perspective view showing the top, front, and right sides of components of a sight assembly, in accordance with an embodiment of the present disclosure.
Figure 8:
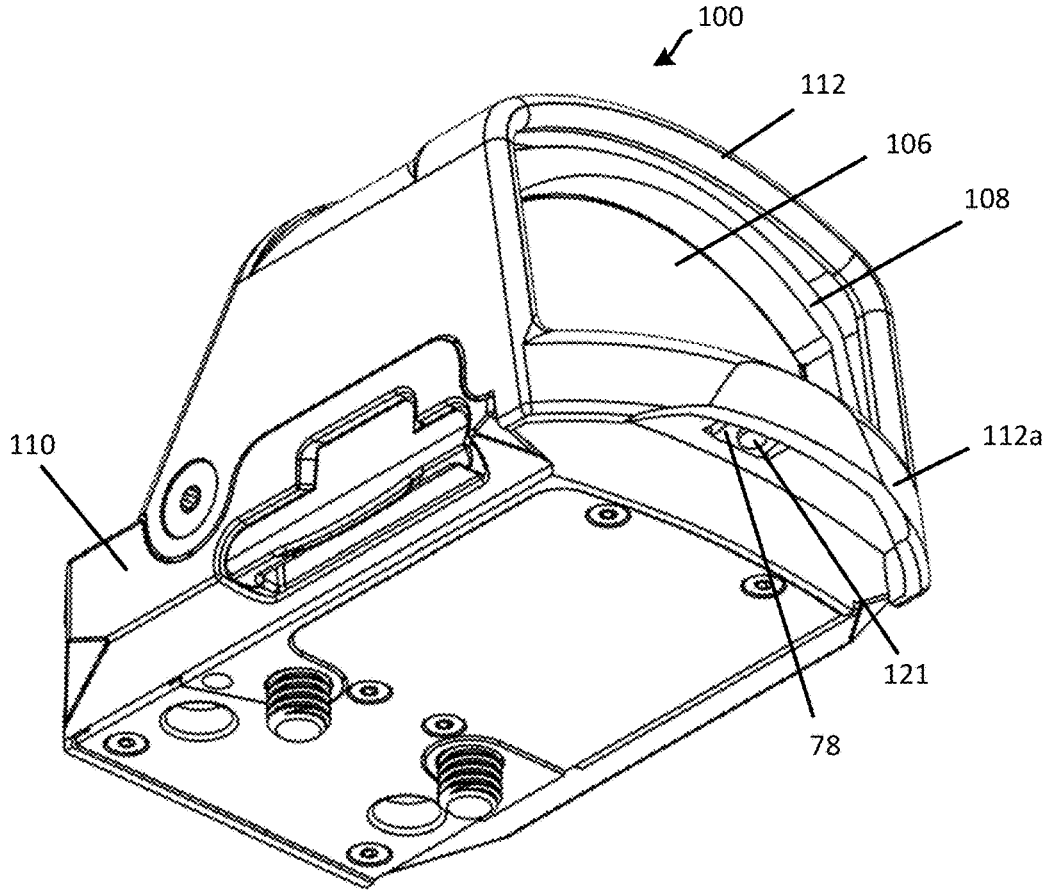
FIG. 8 is a perspective view showing the bottom, front, and right sides of the sight assembly of FIG. 7 in an assembled form, in accordance with an embodiment of the present disclosure.

Referring now to FIGS. 7 and 8, parts of a sight assembly 100 and switch 78 are shown in an exploded front perspective view and in an assembled bottom perspective view, respectively, in accordance with some embodiments of the present disclosure. In this example, the sight assembly 100 is configured as a reflex sight that includes a sight body 110 with a frame 108 retaining a lens 106, a housing 112 configured to attach to the body 110 and fit over the frame 108, a switch 78 on a bottom of the housing 112, and a lever 74 operable with the switch 78. A light source 114 on the sight body 110 provides a point-of-aim indicator 138 on the lens 106 that is visible to the user, as will be appreciated.

A sight housing 112 is attachable to the sight body 110. In this example, the sight housing 112 includes a switch 78 that is positioned for actuation by the lever 74 in the presence of a chambered round. In some embodiments, the switch 78 is on an underside of the housing 112 such that when installed on the handgun, the switch 78 is adjacent the ejection port 54. In one embodiment, such as shown in FIG. 8, the housing 112 includes a forward portion 112*a* that is constructed to be adjacent the rear edge of the ejection port 54 when the sight assembly 100 is installed on the slide 50. The switch 78 can be any one of a variety of electrical switches, such as a micro push button switch, a contact pad, a rocker-type switch, or other suitable switch. In one example discussed above, the lever 74 is displaced upward to depress a push-button switch 78 located on the bottom of the housing 112.

In this embodiment, the lever 74 is a loaded chamber indicator and has a lever body 74*a* that pivots about an axle 74*b* extending crosswise to the lever body 74*a*. The forward end of the lever body 74*a* extends upward as needed to an actuator portion 74*c* that is shaped and configured to actuate the switch 78, such as by simply making contact or by depressing an actuator 79 (e.g., a button)

FIG. 8 illustrates a front and bottom perspective view of the sight assembly 100 of FIG. 7, showing the sight assembly 100 in assembled form. The switch 78 can be seen on the underside of the forward portion 112*a* of the housing 112 and includes a button-type actuator 79 that is positioned to be actuated by the actuator portion 74*c* of the lever 74 (shown in FIG. 7).

Figure 9:
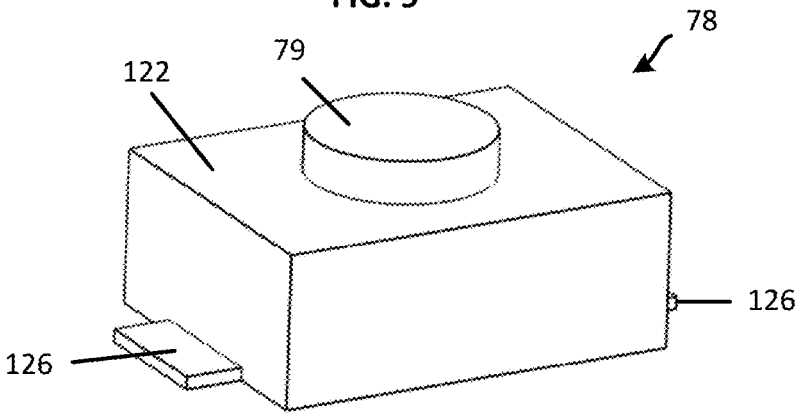
FIG. 9 is a perspective view of a switch as included in the sight assembly of FIG. 7, in accordance with an embodiment of the present disclosure.

FIG. 9 illustrates a perspective view of a switch 78, in accordance with one embodiment. In this example, the switch 78 has a switch body 122 and an actuator 79. In this example, the actuator 79 is a push button that, when depressed, completes a circuit. Contact pads 126 on the switch body 122 can be electrically connected to other components in the electrical circuit, as will be appreciated.

Figure 10:
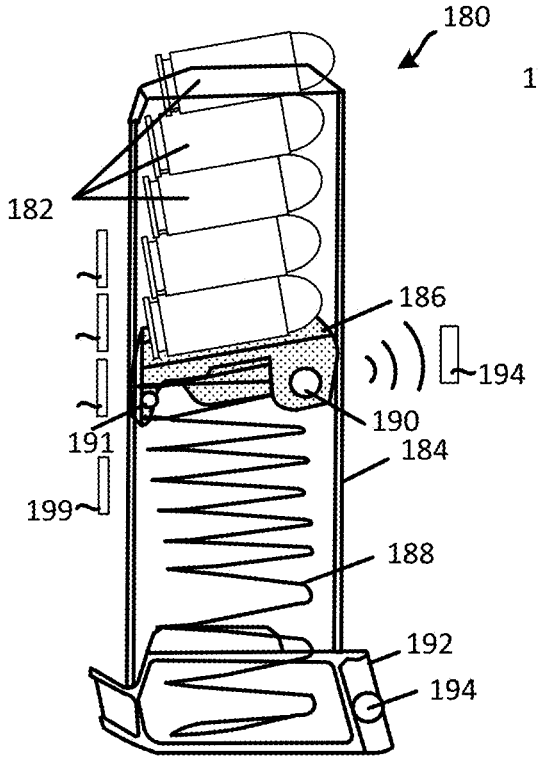
FIG. 10 is a transparent side view of a handgun magazine that includes part of a sensor in the follower, in accordance with an embodiment of the present disclosure.
Figure 11:
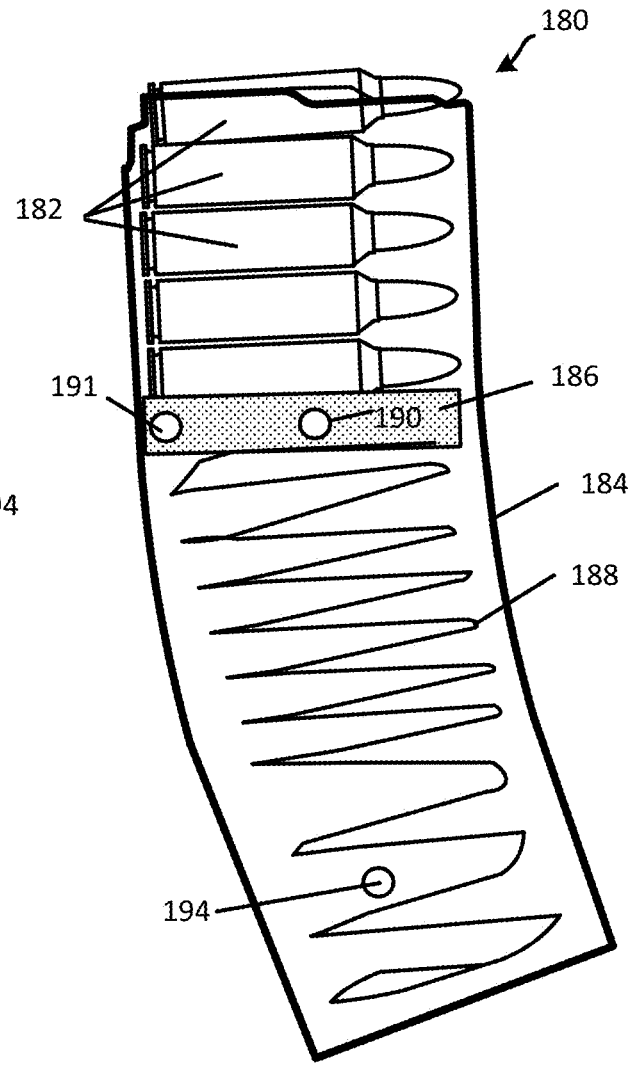
FIG. 11 is a transparent side view of a rifle magazine that includes a sensor component on the follower, in accordance with an embodiment of the present disclosure.

FIGS. 10 and 11 illustrate transparent side views of example handgun and rifle magazines, respectively, in accordance with some embodiments. In these figures, each magazine 180 is partially filled with ammunition cartridges 182 and includes a magazine tube 184, a follower 186, and a magazine spring 188. The follower 186 includes a radio frequency tag 190 (RFID tag or RF tag) that communicates with a chip or transceiver in a sight assembly 100. One such sight assembly 100 is a reflex sight as shown in FIGS. 7-8. Other types of sight assemblies 100 can be used, such as an optical sight with fixed or variable magnification, a rifle scope, or other suitable sight assembly 100.

In some embodiments, the base 192, sidewall, or other portion of the magazine 180, or part of the firearm (e.g., inside of magazine well) optionally includes a reference tag 194 that communicates with the RFID tag 190 and the transceiver in the sight assembly 100. For example, the transceiver uses the distance between the RFID tag 190 and the reference tag 194 to determine the quantity of cartridges 182 in the magazine 180. In FIG. 10, the reference tag 194 is located on the base 192 (e.g., a base plate or grip extension) and in FIG. 11 the reference tag 194 is located on the sidewall of the magazine tube 184. Numerous variations and embodiments will be apparent in light of the present disclosure.

In another embodiment, the follower 186 includes a magnet 191 and the firearm's magazine well includes a plurality of Hall-effect sensors 199 coupled to the sight assembly 100. Based on the position of the follower 186, one of the Hall-effect sensors 199 is sufficiently close to the magnet 191 to change the resistance of the sensor, and thereby enable a sensed condition at the sight assembly 100. Based on the sensed condition—here a position of the follower 186 in the magazine—the sight assembly 100 displays a status indicator 140 to the user.

Figure 12:
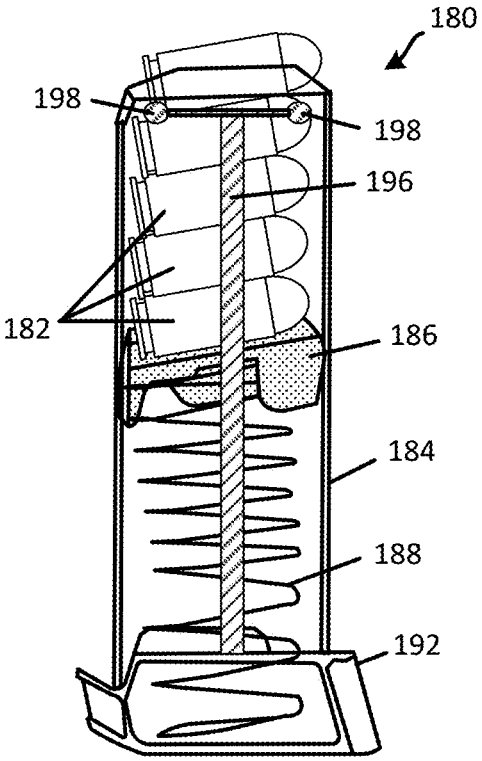
FIG. 12 is a transparent side view of a handgun magazine with a rheostat and electrical contacts, in accordance with an embodiment of the present disclosure.
Figure 13:
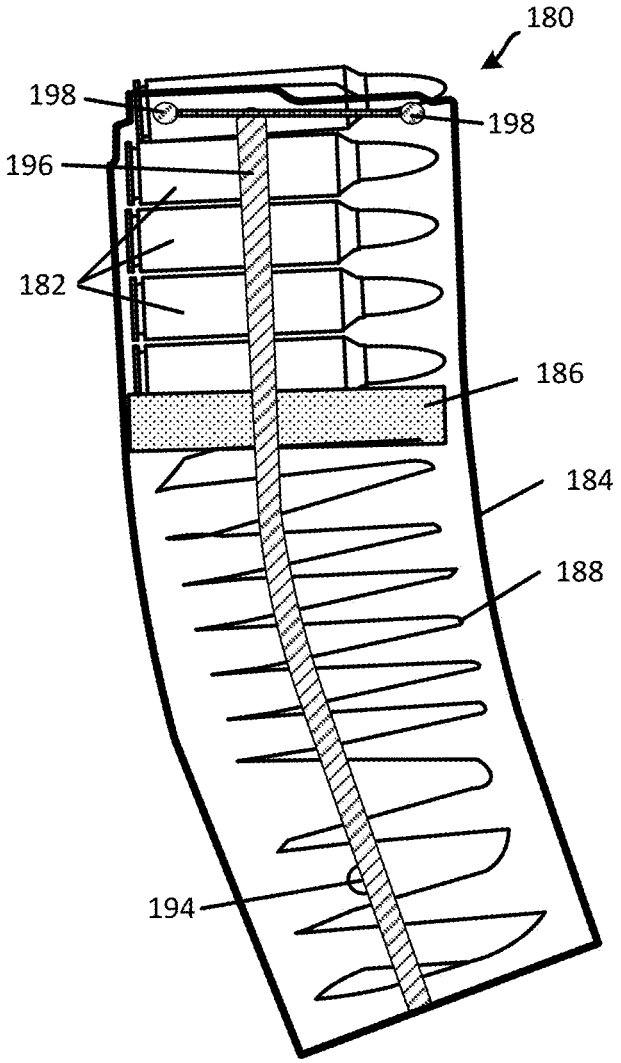
FIG. 13 is a transparent side view of a rifle magazine with a rheostat and electrical contacts, in accordance with an embodiment of the present disclosure.

FIGS. 12 and 13 illustrates transparent side views of pistol and rifle magazines 180, respectively, that can be used in a system that includes sight assembly 100, in accordance with one embodiment. Here, the magazine 180 includes a rheostat 196 in electrical communication with the follower 186. The rheostat 196 also communicates with electrical contact pads 198 on the magazine tube 184. When the magazine 180 is seated in the magazine well of the firearm, the electrical contact pads 198 engage corresponding contact pads in the firearm's magazine well that are in electrical communication with the sight assembly 100. Based on the position of the follower 186 in the magazine tube 184, the sight assembly 100 displays a status indicator 140 to the user, such as the number of rounds in the magazine 180.

FIGS. 14A-14B and 15A-15B illustrate examples of a lens 106 of sight system 101, in accordance with some embodiments of the present disclosure. The lens 106 can be magnifying or non-magnifying glass or other suitable material. Each lens 106 displays at least one status indicator 140, which can be a symbol displayed by illumination (e.g., LED or laser), a liquid crystal display, or some other means. The lens 106 may also include a reticle 200, such as cross hairs or other symbol that can be all or part of the point of aim indicator 138. Although shown as being visible on the lens 106, one or more of the status indicators 140 can be displayed on another portion of the sight assembly 100, such as discussed above. Each status indicator 140 and point-of-aim indicator 138 can be made visible to the user using an LED, laser reflection, liquid crystal, or some other suitable method. In some embodiments, the reticle 200 is scribed in or printed on the lens 106. In some embodiments, the status indicator(s) 140 and/or point-of-aim indicator 138 can include a permanent outline printed on or scribed into the lens 106. For example, the status indicator 140 includes a black outline of a box or circle, where the status indicator 140 is illuminated within the outline.

Figure 14A:
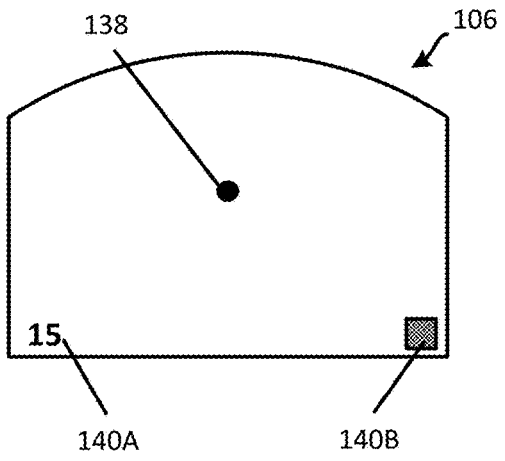
FIG. 14A illustrates an example lens of a reflex sight with a point-of-aim indicator and status indicators that communicate a first firearm status to the user, in accordance with an embodiment of the present disclosure.
Figure 14B:
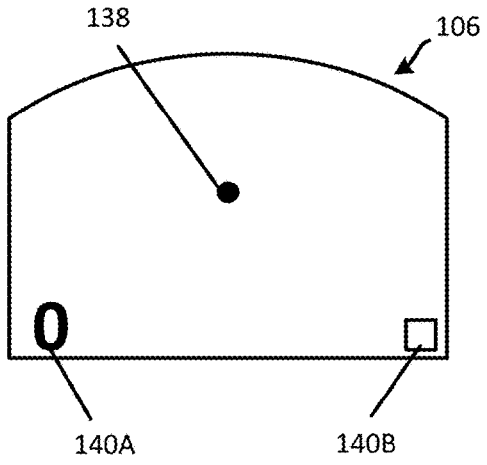
FIG. 14B illustrates another example of a lens of the reflex sight of FIG. 14A with the status indicators communicating a second firearm status to the user, in accordance with an embodiment of the present disclosure.

The lens 106 of FIGS. 14A-14B is part of a reflex sight assembly 100 and includes a point-of-aim indicator 138, a first status indicator 140A, and a second status indicator 140B. The status indicators 140 have a first setting in FIG. 14A and a second setting in FIG. 14B. In FIG. 14A, for example, the first status indicator 140A identifies the number of rounds in the magazine 180 and the second status indicator 140B is a symbol that indicates a loaded chamber. After emptying the magazine 180, for example, the first status indicator 140A of FIG. 14B now shows zero rounds in the magazine 180 and the second status indicator 140B indicates an empty chamber.

Figure 15A:
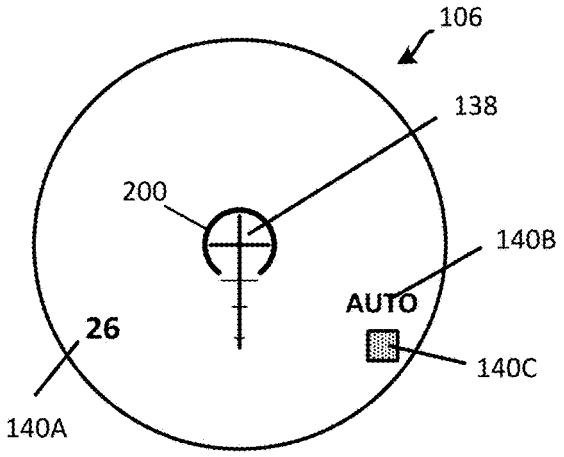
FIG. 15A illustrates a lens of a rifle sight with a point-of-aim indicator and firearm status indicators showing a first firearm status, in accordance with an embodiment of the present disclosure.
Figure 15B:
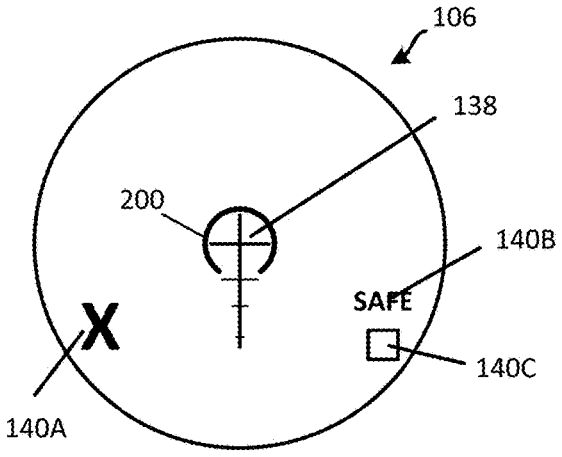
FIG. 15B illustrates the lens of FIG. 15B with the status indicators showing a second firearm status, in accordance with an embodiment of the present disclosure.

The lens 106 of FIGS. 15A-15B is part of a sight assembly 100, such as a telescopic rifle sight, and includes an optional reticle 200, a point-of-aim indicator 138, a first status indicator 140A, a second status indicator 140B, and a third status indicator 140C. Some or all status indicators 140 have a first setting in FIG. 15A and a second setting in FIG. 15B. In FIG. 15A, for example, the first status indicator 140A identifies the number of rounds in the magazine 180, the second status indicator 140B indicates the position of the rifle's selector switch, and the third status indicator 140C is a symbol (e.g., green illumination) that indicates a loaded chamber. After firing all rounds in the magazine 180 and moving the selector to the safe position, for example, the first status indicator 140A now shows a symbol (e.g., red X) to indicate an empty magazine 180, the second status indicator 140B indicates "SAFE" for the selector position, and the third status indicator 140C has a different appearance (e.g., no or yellow illumination) to indicate an empty chamber.

Figure 16A:
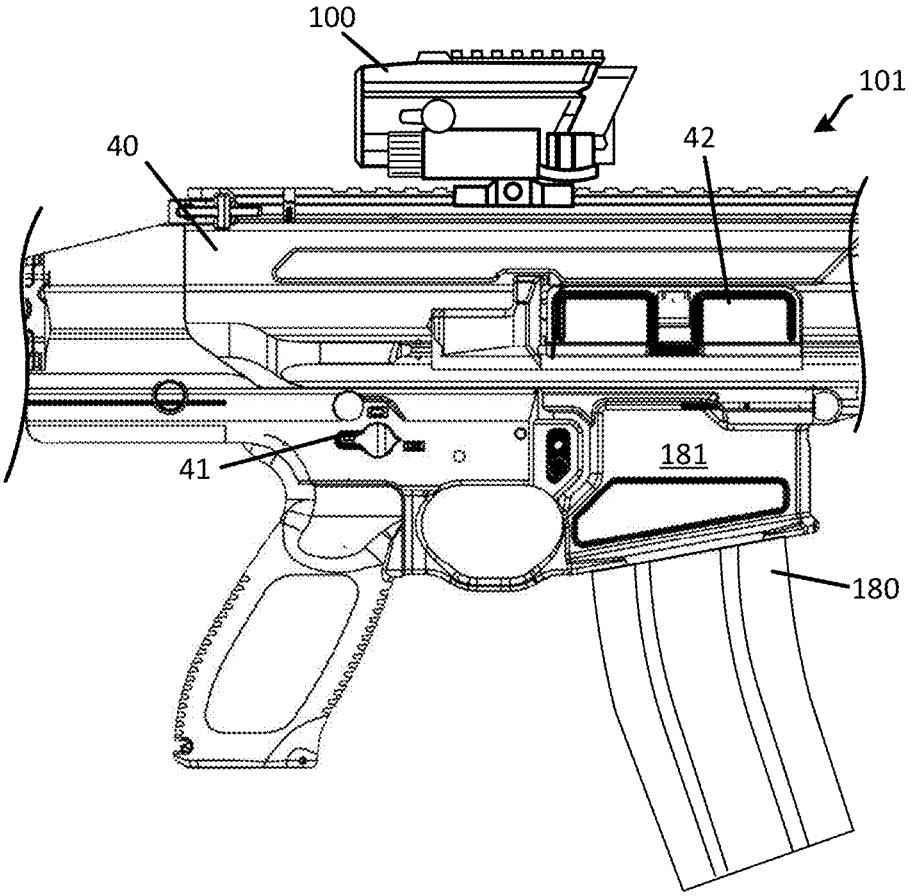
FIG. 16A illustrates an elevational view showing the right side of part a firearm with an optical sight system mounted to a top of the firearm, in accordance with an embodiment of the present disclosure.
Figure 16B:
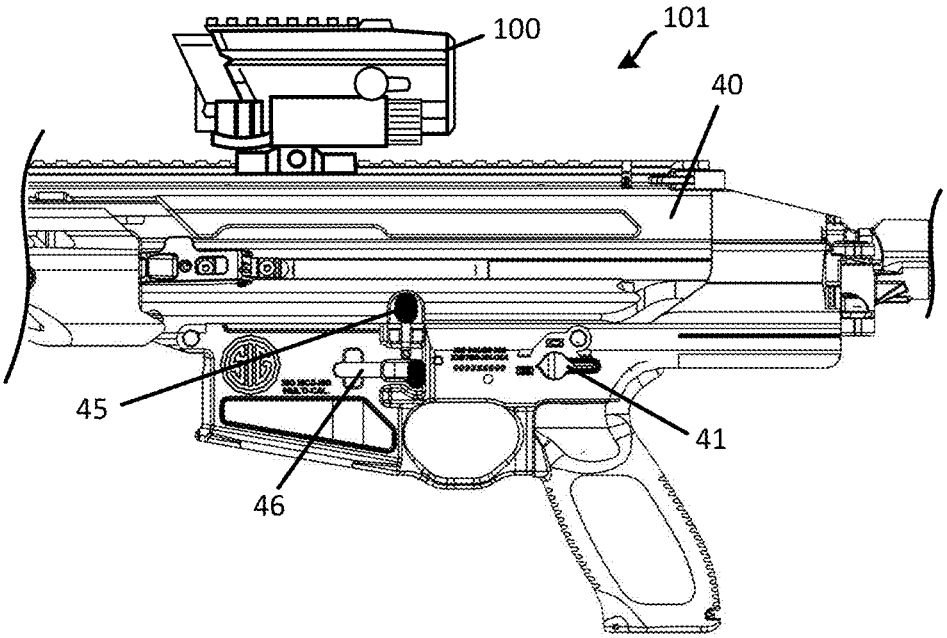
FIG. 16B illustrates an elevational view showing the left side of the firearm part of FIG. 16A, in accordance with an embodiment of the present disclosure.

FIGS. 16A and 16B illustrate opposite side views of part of a firearm with a sight assembly 100. In this example, the firearm 40 and sight assembly 100 are components of a sight system 101, in accordance with an embodiment of the present disclosure. In this example, the sight system 101 includes a firearm 40 with a removable magazine 180, and a sight assembly 100 mounted to the firearm 40. In this example, the firearm 40 is a rifle, but can be a handgun or other firearm, as will be appreciated. The firearm's chamber 42 includes a lever 74 that interacts with a chambered round 70 (not visible) and communicates a first status (e.g., chambered round) to the sight assembly 100. The magazine 180 is seated in the magazine well 181 of the firearm 40 and communicates a second status (e.g., round count) to a transceiver (not visible) in the sight assembly 100, which in turn can be displayed to the user on or in the sight assembly 100. Optionally, and where so equipped, a selector switch 41 (or safety switch) communicates a third status to the sight assembly, such as the position of the selector.

FIG. 16B shows the left side of the firearm 40 shown in FIG. 16A. In addition to the selector switch 41, the firearm 40 includes a bolt release lever 45 and a magazine release lever 46, each of which can be used to actuate a switch or complete a circuit as part of the sight system 101.

A sight assembly 100 or sight system 101 in accordance with some embodiments of the present disclosure can be used in a method of tracking firearm data. For example, the sight assembly 100 includes a chip configured to record shooting data. The sight assembly 100 may include an accelerometer or equivalent to detect recoil forces. When a shot is fired, recoil detected by the chip causes the chip to record shot data. The shot data can include, for example, the time and date, shot number for the day, shot number of total shots fired, muzzle orientation, muzzle orientation after the shot (e.g., muzzle flip), GPS location information, and other data deemed suitable.

Figure 17A:
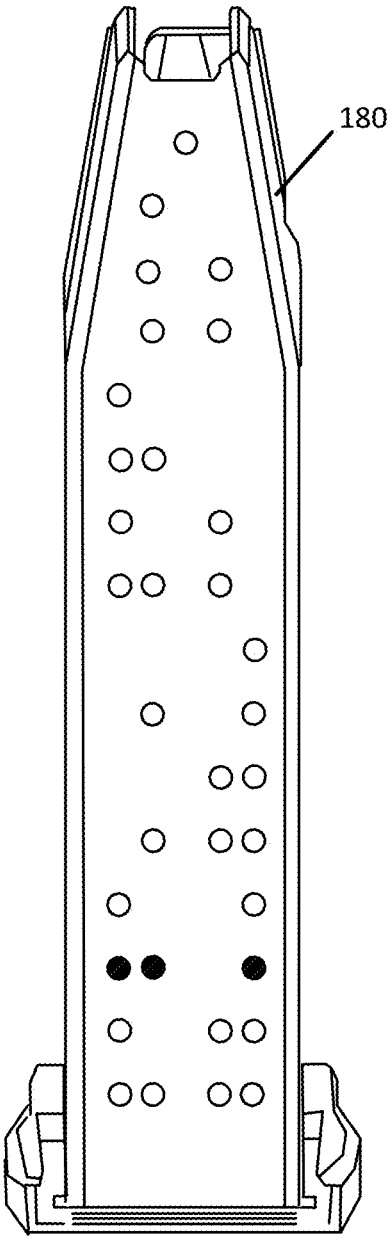
FIGS. 17A and 17B illustrate a rear view of a magazine having openings or sensors positioned according to a binary counting pattern, in accordance with an embodiment of the present disclosure.
Figure 17B:
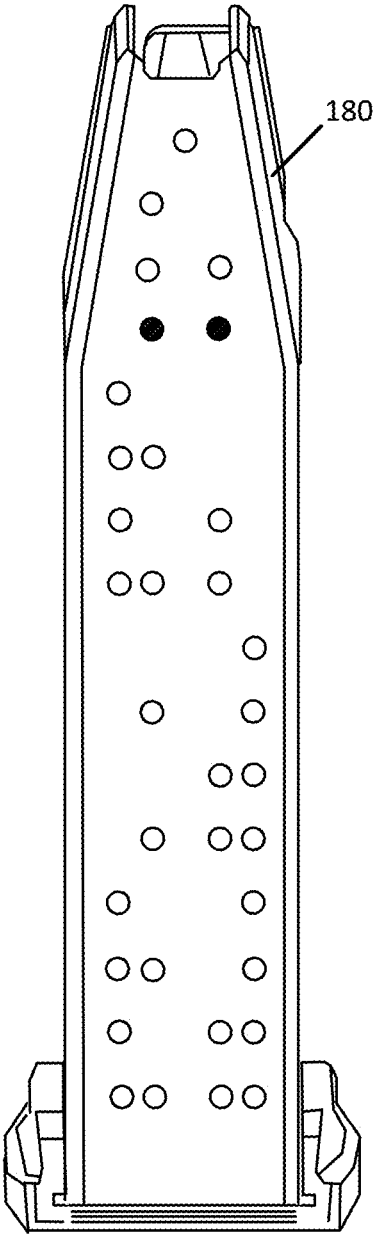

FIGS. 17A and 17B illustrate rear views of a handgun magazine 180 in accordance with an embodiment of the present disclosure. In this example, the magazine 180 includes sensor components arranged columns on the rear face of the magazine 180, where each column indicates a binary count of 1, 2, 4, or 8. An additional column can be used as an empty or null value. Using this arrangement with a row of five tritium vials on the rear face of the follower and openings in the rear wall of the magazine corresponding to a round count in the magazine, photo sensors can be positioned in the magazine well to detect light. Based on the sensors receiving light, the number of rounds in the magazine can be determined and communicated to the sight assembly and displayed to the user. Table 1 below is an example of one such arrangement where the value of 1 in the table indicates indicate the number of 1s, 2s, 4s, and 8s and add to provide the total round count.

TABLE 1

| 4s | 1s | Empty | 2s | 8s | Count |
|---|---|---|---|---|---|
| | | 1 | | | 0 |
| | 1 | | | | 1 |
| | | | 1 | | 2 |
| | 1 | | 1 | | 3 |
| 1 | | | | | 4 |
| 1 | 1 | | | | 5 |
| 1 | | | 1 | | 6 |
| 1 | 1 | | 1 | | 7 |
| | | | | 1 | 8 |
| | 1 | | | 1 | 9 |
| | | | 1 | 1 | 10 |
| | 1 | | 1 | 1 | 11 |
| 1 | | | | 1 | 12 |
| 1 | 1 | | | 1 | 13 |
| 1 | | | 1 | 1 | 14 |
| 1 | 1 | | 1 | 1 | 15 |

In FIG. 17A, black-filled circles correspond to illuminated openings that provide light to photo sensors. This particular pattern indicates 13 rounds remain in the magazine 180 based on the Table 1 above. In FIG. 17B, three rounds remain in the magazine 180.

In another embodiment, the magazine 180 includes one opening for each count value, as shown by Xs in Table 2 below. Based on the combination of horizontal position and vertical position, the number of rounds can be determined. According to this method, each count has a single position to align with an optical sensor, Hall-effect sensor, or other suitable sensor. An advantage of such an embodiment is a reduction in the number of sensors needed and the reduced likelihood of overlap between sensors and openings.

TABLE 2

| A | B | Empty | C | D | Count |
|---|---|---|---|---|---|
| | | X | | | 0 |
| | | | X | | 1 |
| | X | | | | 2 |
| | | | | X | 3 |
| X | | | | | 4 |
| | | | X | | 5 |
| | X | | | | 6 |
| | | | | X | 7 |
| X | | | | | 8 |
| | | | X | | 9 |
| | X | | | | 10 |
| | | | | X | 11 |
| X | | | | | 12 |
| | | | X | | 13 |
| | X | | | | 14 |
| | | | | X | 15 |

Figure 18A:
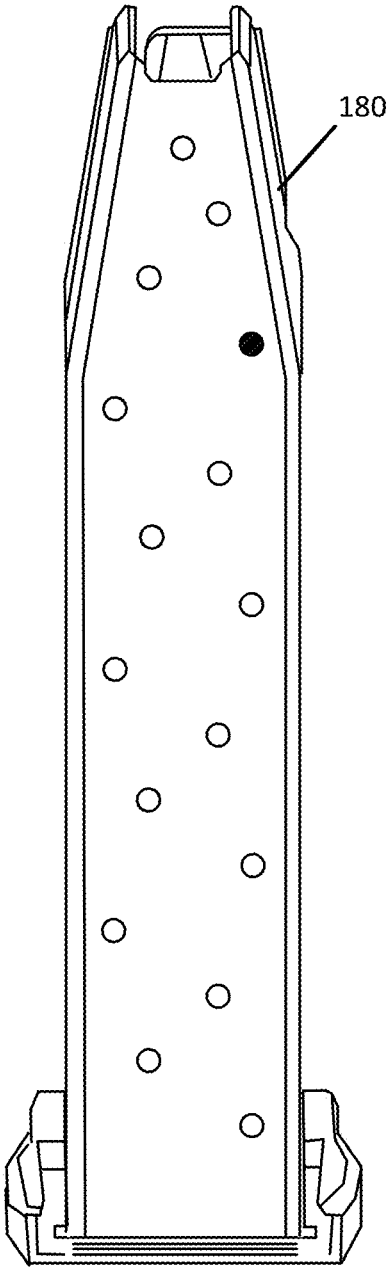
FIGS. 18A and 18B illustrate a rear view of a magazine having openings or sensors positioned according to predetermined locations that indicate the number of rounds present in the magazine, in accordance with an embodiment of the present disclosure.
Figure 18B:
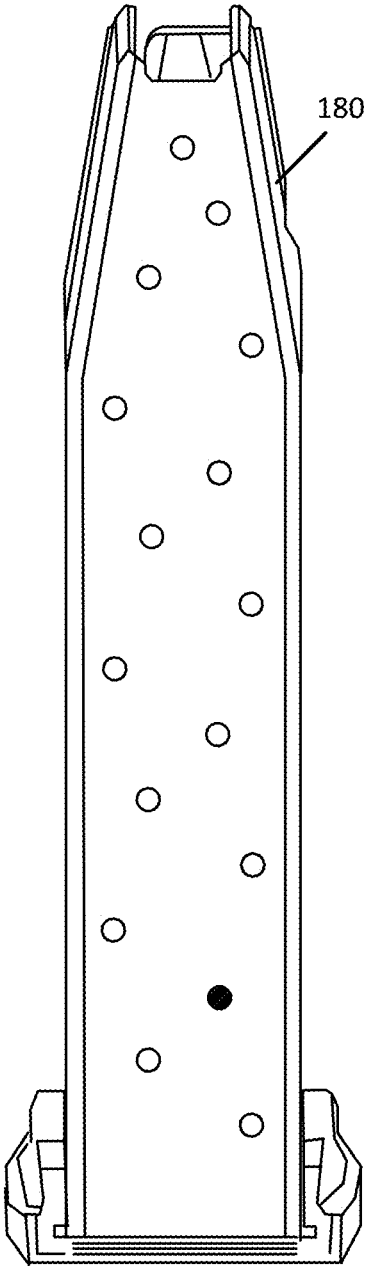

Consistent with the locations shown in Table 2 above, the magazine 180 in FIG. 18A contains three rounds, the magazine in FIG. 18B contains 13 rounds.

Figure 19:
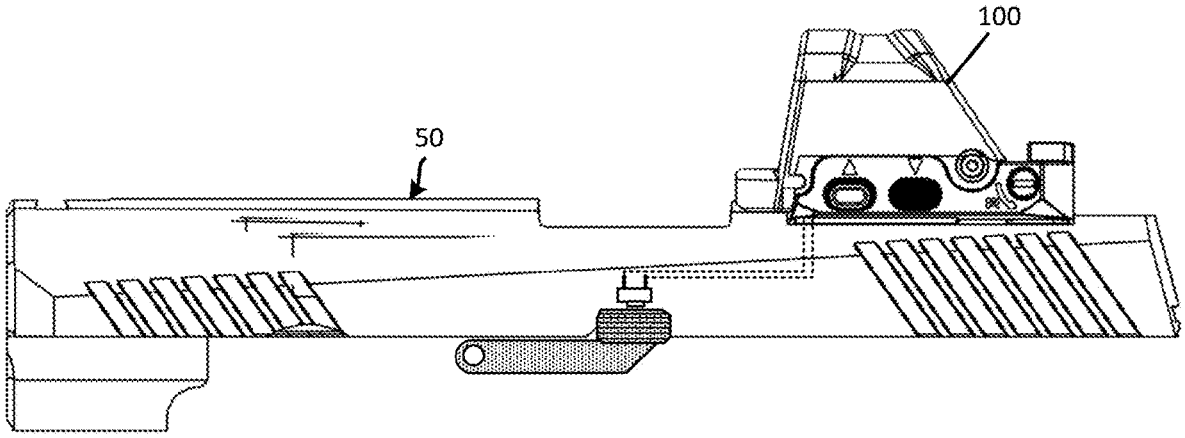
FIG. 19 illustrates a side view of a slide with sight assembly, where the slide lock lever is one lever used to actuate a switch and display a status to the user, in accordance with an embodiment of the present disclosure.

FIG. 19 illustrates a side view of a handgun slide 50 with sight assembly 100 configured as a reflex sight, in accordance with an embodiment of the present disclosure. In this example, the slide lock lever 86 actuates a switch 78 when the magazine is empty. The switch 78 is coupled to the sight assembly 100. In doing so, a circuit is closed and the sight assembly 100 displays a status indicator to the user. Electrical connections are achieved by wires or conductive traces in some embodiments.

Figure 20:
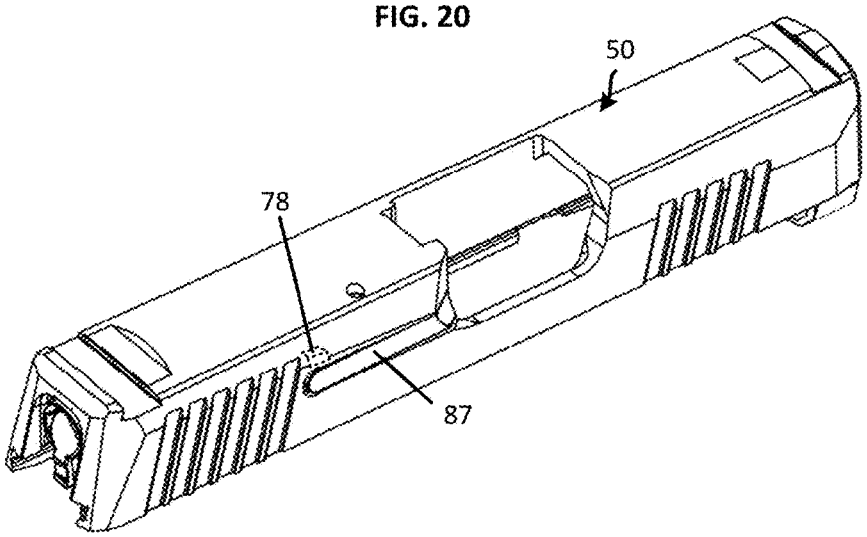
FIG. 20 is a rear and top perspective view of a handgun slide where the extractor is used to actuate a switch that is part of a circuit with a sight assembly, in accordance with an embodiment of the present disclosure.

FIG. 20 illustrates a rear and top perspective view of a handgun slide 50, in accordance with an embodiment of the present disclosure. Here, the sight assembly 100 is omitted to more clearly show components of the slide 50. Similar to the embodiment of FIG. 19, the extractor 87 is one type of lever that can be used to actuate a switch embedded in the slide 50, on the outside of the slide 50, or in some other suitable location. The switch 78 (shown in broken lines) is embedded in the slide and communicates with the sight assembly 100 (not shown) via wires, conductive traces, or other suitable method.

In a first example embodiment, a sight assembly 100 is configured as a reflex sight for a handgun. The sight assembly 100 includes a shroud or sight body 110 and a lens 106 in a vertical plane facing the user. In addition to the point-of-aim indicator 138, an LED on the rear face of the sight body 110 is visible to the user. The handgun slide includes a loaded chamber indicator that toggles between a down position, when the chamber is empty, and an up position when a round is chambered. In the up position, the loaded chamber indicator depresses a microswitch that turns on the LED. When activated, the LED is illuminated in a green color to indicate the chamber is loaded. When the chamber is empty, the microswitch is not actuated and the LED is not illuminated. Alternately, the LED may be illuminated in yellow or some other color to indicate an empty chamber or non-battery condition.

In a second example embodiment, a reflex sight assembly 100 for a handgun includes a sight body 110 that retains a lens 106 in a vertical plane facing the user. In addition to the point-of-aim indicator 138, an LED or laser on the body 110 is positioned to shine light on the lens 106 to provide a status indicator 140 to the user. In this example, the status indicator 140 communicates to the user whether a magazine 180 is installed in the magazine well. When the magazine 180 is seated in the magazine well, an electrical contact pad 198 on the magazine 180 makes contact with a corresponding contact pad on the inside of the handgun. When the magazine 180 is seated in the magazine well, the sight assembly 100 displays a status indicator 140 on the lens 106, such as a green circle. When the magazine 180 is removed from the magazine well, the status indicator 140 changes to a yellow circle. In one embodiment, the sight assembly 100 also detects the position of the follower 186 in the magazine 180. For example, the electrical contact pad 198 is part of a circuit with a rheostat 196 along the magazine tube 184. As the follower 186 moves up the magazine tube 184, a change in voltage or other electrical signal is used to determine the number of rounds 70 in the magazine 180. Accordingly, the sight assembly 100 may display a number instead of or in addition to the status indicator (e.g., green light) for the chambered round 70. For example, when four rounds remain, the status indicator 140 displays the number 4, and when the magazine 180 is removed, the status indicator 140 displays the number zero and color changes to yellow.

In a third example embodiment, a sight assembly 100 is configured as a rifle scope with 1-6× magnification and mounted to a firearm 40 (e.g., rifle). The sight assembly 100 includes a lens 106 with an illuminated reticle 220 having variable illumination for shooting in low light or bright light conditions. The lens 106 includes a point-of-aim indicator 138 with a circle, plus, triangle, or some other symbol. In addition to the point-of-aim indicator 138, the lens 106 displays one or more status indicators 140 for the firearm 40. In one embodiment, the sight assembly 100 displays a numerical status indicator 140 representative of the number of rounds in a seated magazine 180. When the magazine 180 is seated in the magazine well, an electrical contact pad 198 on the magazine 180 makes contact with a corresponding contact pad on the inside of the rifle. The electrical contact pad 198 is part of a circuit with a rheostat 196 along the magazine tube 184. An electrical signal (e.g., voltage) received at the sight assembly' 100 circuit is translated to a number representative of the follower position, and therefore of the number of rounds or cartridges 182 remaining in the magazine 180. When the magazine 180 is seated in the magazine well 181, the lens 106 displays the number of rounds or cartridges 182 in the magazine 180. When the magazine 180 is removed from the magazine well 181, the lens 106 displays an X; when the magazine 180 is empty, the lens 106 displays the number zero. In one embodiment, the number is located along the perimeter of the lens 106 so as to minimize interference with the point-of-aim indicator 138, such as at the 3:00 position, 4:30 position, 7:30 position, or 9:00 position.

In another embodiment, the follower 186 includes a magnet 191. As the follower position changes in the magazine, the magnet occupies positions in close proximity to Hall-effect sensors in the magazine well. Based on the position of the follower 186 in the magazine 180, the lens 106 displays a number representing the number of cartridges 182 in the magazine. When the magazine 180 is removed from the magazine well 181, the lens 106 displays an X; when the magazine 180 is empty, the lens 106 displays the number zero. In one embodiment, the handgun magazine well includes a distinct Hall-effect sensor for each position of the follower. The Hall-effect sensor in close proximity with the magazine results in a circuit value (e.g., resistance or voltage) that is converted to a numerical value for round count.

Note that in these examples the circuit can be included in the sight assembly 100, such as being housed in the sight body 110. Alternately, the circuit may be separate from the sight assembly 100, such as being attached to or retained in the firearm 40.

In another embodiment, the sight assembly 100 displays a status indicator 140 for the chamber 42 or position of the selector switch 41. For example, the selector switch 41 has a switch position for each of the various positions (e.g., safe, auto, semi, burst) of the selector switch 41. Thus, in addition to the user sensing the position of the selector switch 41 by feel, the lens 106 displays a status indicator 140 that communicates the position of the selector switch 41 to the user.

FURTHER EXAMPLE EMBODIMENTS

The following examples pertain to further embodiments, from which numerous permutations and configurations will be apparent.

Example 1 is a sight assembly for a firearm, the assembly comprising an optical sight configured for mounting to a firearm, the optical sight including a sight body retaining a lens and a point-of-aim indicator visible on the lens; a light source on the sight body, the light source configured to communicate a firearm status to a user.

Example 2 includes the subject matter of Example 1, wherein the sight body is constructed for mounting to a handgun slide.

Example 3 includes the subject matter of Example 1, wherein the sight body is constructed for mounting to a rail of a firearm.

Example 4 includes the subject matter of any of Examples 2 or 3, wherein the optical sight is configured as a reflex sight.

Example 5 includes the subject matter of any of Examples 1-4, wherein the firearm status is selected from (i) a loaded chamber status, (ii) a number of cartridges in a magazine, and (iii) a safety position.

Example 6 includes the subject matter of any of Examples 1-5 and further comprises a switch on the sight body, and a lever on the firearm, the lever movable to actuate the switch in response to a cartridge chambered in a chamber of the firearm.

Example 7 includes the subject matter of Example 6, wherein the lever occupies a first position when a cartridge is chambered in the chamber and the switch occupies a second position when a cartridge is not chambered in the chamber, wherein the first position actuates the switch on the sight body.

Example 8 includes the subject matter of any of Examples 1-7, wherein the light source is configured to have a first illumination state indicating a first firearm status and a second illumination state indicating a second firearm status.

Example 9 includes the subject matter of Example 8, wherein the first illumination state is a first color and the second illumination state is a second color different from the first color.

Example 10 includes the subject matter of Example 8, wherein the first illumination state is an on state and the second illumination state is an off state.

Example 11 includes the subject matter of any of Examples 1-10, wherein the status indicator includes one or more of (i) a color, (ii) a number, and (iii) a symbol.

Example 12 includes the subject matter of any of Examples 1-11, wherein the firearm status is a first firearm status and the assembly is configured to communicate at least one additional firearm status to the user.

Example 13 includes the subject matter of Example 12 and further comprises a magazine having a follower with a magnet or RFID tag. In the case of an RFID tag, the tag communicates a follower position to the sight assembly. In the case of a magnet, Hall-effect sensors in the magazine well sense the position of the follower, where the Hall-effect sensors are coupled to the sight assembly. Thus, when the magazine is installed in the firearm, the position of the follower results in a signal at the sight assembly that is converted to a value for round count. In turn, a lens of the sight assembly displays a number of rounds in the magazine.

Example 14 includes the subject matter of Example 12 and further comprises a magazine with a magazine tube and a follower retained within the magazine tube; a rheostat along the magazine tube; a first electrical contact pad on the magazine; and a second electrical contact pad on the firearm, wherein the first electrical contact pad engages the second electrical contact pad when the magazine is seated in a magazine well of the firearm; wherein the rheostat, the first electrical contact pad, and the second electrical contact pad are part of a circuit that communicates to the optical sight a position of the follower, and wherein the sight assembly is configured to provide on a lens a symbol representing the position of the follower when the magazine is seated in the firearm.

Example 15 includes the subject matter of Example 14, wherein the lens displays a number of rounds in the magazine.

Example 16 includes the subject matter of Example 14 or 15, wherein the lens displays a loaded chamber status.

Example 17 includes the subject matter of any of Examples 1-16, wherein the firearm is a handgun.

Example 18 includes the subject matter of any of Examples 1-16, wherein the firearm is a rifle.

Example 19 is a subassembly for a semiautomatic handgun, the subassembly comprising a slide constructed for reciprocal sliding movement along a top of a handgun frame; a lever received in a top of the slide, the lever movable between a first position when a cartridge is chambered in a chamber of the handgun and a second position when no round is chambered in the chamber; and an optical sight mounted to the top of the slide, the optical sight including (i) a base configured for mounting on the slide, (ii) a lens substantially oriented in a vertical plane when the slide is oriented horizontally (iii) a point-of-aim indicator visible on the lens; and (iv) a light source in the base, the second light source configured to provide a chamber status indicator visible to a user; and a switch operatively coupled to the lever, wherein the light source has a first illumination state when a round is chambered in the chamber and the light source has a second illumination state in the absence of a chambered round.

Example 20 includes the subject matter of Example 19, wherein a round chambered in the chamber displaces the lever upward into contact with the switch on the optical sight.

Example 21 includes the subject matter of Example 19 or 20, wherein the light source is visible on a rear end portion of the base.

Example 22 includes the subject matter of Example 19 or 20, wherein the light source is visible on the lens.

Example 23 includes the subject matter of any of Examples 19-22, wherein the first illumination state provides a symbol of a first color and the second illumination state provides the symbol of a second color different from the first color.

Example 24 includes the subject matter of any of Examples 19-22, wherein the first illumination state is an on state and the second illumination state is an off state.

Example 25 includes the subject matter of any of Examples 19-24 and further comprises a receiver in the base, wherein the switch communicates wirelessly with the receiver; an additional light source in the base, wherein the receiver is further configured to receive a signal from a sensor on the firearm, and wherein the additional light source is configured to provide at least one additional firearm status indicator visible to the user based on the signal received from the sensor.

Example 26 includes the subject matter of Example 25 and further comprises a magazine including a follower. The follower or the magazine well includes a sensor configured to communicate a position of the follower to the receiver.

Example 27 includes the subject matter of Example 25 or 26, wherein the sensor communicates wirelessly with the receiver.

Example 28 includes the subject matter of Example 26, wherein the sensor includes a RFID tag or Hall-effect sensor.

Example 29 includes the subject matter of any of Examples 19-28 and further comprises a second sensor on the safety selector switch, the optical sight configured to display a position of the safety selector switch based on a signal from the second sensor.

Example 30 is a firearm including the assembly of any of claims 1-18.

Example 31 includes the subject matter of Example 30, wherein the firearm is a handgun.

Example 32 includes the subject matter of Example 30, wherein the firearm is a rifle or machine gun.

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A sight assembly for a firearm, the assembly comprising:

an optical sight configured for mounting to a firearm, the optical sight including a sight body retaining a lens and configured to provide a point-of-aim indicator on the lens;

a light source on the sight body, the light source configured to display an indicator to communicate a firearm status to a user; and a switch on the sight body, the switch positioned and configured to be actuated by a lever on a firearm when the sight assembly is mounted to the firearm, wherein the lever is movable in response to a cartridge chambered in a chamber of the firearm, and wherein the lever occupies a first position when a cartridge is chambered in the chamber and the lever occupies a second position when the chamber is empty.

2. The assembly of claim 1, wherein the optical sight is configured as a reflex sight.

3. The assembly of claim 2, wherein the light source is positioned to illuminate the indicator on the lens and the firearm status comprises one or more of (i) a loaded chamber status, (ii) a quantity of ammunition in a magazine, and (iii) a position of a mechanical safety of the firearm.

4. The assembly of claim 3, wherein the indicator comprises one or more of (i) a color, (ii) a number, and (iii) a symbol.

5. The assembly of claim 1, further comprising:

the firearm having the lever movable to actuate the switch in response to a cartridge chambered in the chamber of the firearm.

6. The assembly of claim 5, wherein the lever is selected from (i) a chamber status indicator, (ii) a slide lock lever, (iii) an extractor, or (iv) a bolt release lever.

7. The assembly of claim 1, wherein the light source provides light of a first color to indicate a first firearm status and provides light of a second color to indicate a second firearm status.

8. A subassembly for a semiautomatic handgun, the subassembly comprising:

a slide constructed for reciprocal sliding movement along a top of a handgun frame;

a lever received in a top of the slide, the lever movable between a first position when a cartridge is chambered in a chamber of the semiautomatic handgun and a second position when the chamber is empty; and an optical sight mounted to a top of the slide, the optical sight including a housing with a base configured for mounting on the slide;

a lens retained in the housing;

a point-of-aim indicator visible on the lens to a user; and a light source configured to provide a chamber status indicator visible to the user; and a switch operatively coupled to the lever, wherein the light source has a first illumination state when a round is chambered in the chamber and the light source has a second illumination state when the chamber is empty.

9. The subassembly of claim 8, wherein when the cartridge is chambered in the chamber, the lever actuates the switch to provide the chamber status indicator to the user.

10. The subassembly of claim 8, wherein the light source is visible on a rear end portion of the base.

11. The subassembly of claim 8, wherein the light source is visible on the lens.

12. The subassembly of claim 8, wherein the first illumination state displays a first color to the user and the second illumination state displays a second color different from the first color.

13. The subassembly of claim 8, wherein the first illumination state is an on state and the second illumination state is an off state.

14. The subassembly of claim 8, further comprising:

a signal receiver on the optical sight, wherein the signal receiver communicates with the switch;

an additional light source on the housing, wherein the signal receiver is further configured to receive a signal from one or more sensors on the handgun, and wherein the additional light source is configured to provide at least one additional firearm status indicator visible to the user based on signal received from the sensor.

15. The subassembly of claim 14 further comprising:

a handgun frame including rails, wherein the slide is slidably mounted on the rails and wherein the handgun frame includes a handgrip portion defining a magazine well;

a magazine including a follower, the magazine configured to be installed in the magazine well;

the one or more sensors disposed in the magazine well and positioned so that when the magazine is installed in the magazine well, each of the one or more sensors is configured to wirelessly communicate the signal to the signal receiver, the signal indicative of a position of the follower in the magazine well.

16. The subassembly of claim 15, wherein the one or more sensors comprises a plurality of Hall-effect sensors and wherein the follower includes a magnet, and wherein the additional light source displays a quantity of ammunition in the magazine in response to the signal.

17. A semiautomatic handgun comprising:

a handgun frame;

a slide assembly configured to reciprocate along the handgun frame, the slide assembly including a barrel defining a chamber;

a lever on the slide, wherein the lever occupies a first position when a cartridge is chambered in the chamber and the switch occupies a second position when the chamber is empty; and an optical sight assembly on the slide, the optical sight assembly comprising:

a sight body retaining a lens, the sight body configured to provide a point-of-aim indicator on the lens;

a light source on the sight body, the light source configured to display an indicator to communicate a firearm status to a user; and a switch on the sight body, the switch positioned and configured to be actuated by the lever on the slide.

18. The assembly of claim 17, wherein the optical sight assembly is configured as a reflex sight.

19. The assembly of claim 17, wherein the light source is positioned to illuminate the indicator on the lens and the firearm status comprises a loaded/unloaded chamber status.

20. The assembly of claim 19, wherein the indicator comprises one or more of a color, a number, and a symbol.

21. The assembly of claim 17, wherein the light source is positioned to illuminate the indicator on the lens and the firearm status comprises position of a mechanical safety of the firearm.

22. The assembly of claim 17, wherein the lever is selected from a chamber status indicator, a slide lock lever, an extractor, or a safety actuator.

* * * * *